US007316640B2

(12) United States Patent
Markwardt

(10) Patent No.: US 7,316,640 B2
(45) Date of Patent: Jan. 8, 2008

(54) CRAFT-MAKING TOOL

(76) Inventor: Terry Markwardt, 2106 Key West Cove, Austin, TX (US) 78746

( * ) Notice: Subject to any disclaimer, the term of this patent is extended or adjusted under 35 U.S.C. 154(b) by 6 days.

(21) Appl. No.: 11/195,317

(22) Filed: Aug. 2, 2005

(65) Prior Publication Data

US 2007/0032362 A1 Feb. 8, 2007

(51) Int. Cl.
*B31B 1/50* (2006.01)

(52) U.S. Cl. ..... 493/143; 493/145; 493/156

(58) Field of Classification Search ..... 493/143, 493/167, 185, 145, 146, 156–158
See application file for complete search history.

(56) References Cited

U.S. PATENT DOCUMENTS 3,802,206 A * 4/1974 Moore et al. ..... 405/251
3,909,881 A 10/1975 Anderson
5,037,234 A * 8/1991 De Jong ..... 403/268
5,570,675 A * 11/1996 Treadway ..... 124/23.1
6,932,753 B1 * 8/2005 Smith et al. ..... 493/167
7,108,369 B2 * 9/2006 Newsome et al. ..... 347/107

* cited by examiner

*Primary Examiner*—Hemant M. Desai
(74) *Attorney, Agent, or Firm*—David O. Simmons

(57) ABSTRACT

A tool for forming articles from sheets of conformable material comprises a base and a handle. The base includes a circular-shaped groove formed in a face thereof whereby the circular-shaped groove defines a circular-shaped protrusion encompassed thereby. The handle includes a circular-shaped annular extension engagable within the circular-shaped groove for enabling an engaged portion of a sheet of conformable material positioned between the base and the handle to be conformed within the circular-shaped groove by forcibly engaging the circular-shaped annular extension within the circular-shaped groove.

8 Claims, 9 Drawing Sheets

CRAFT-MAKING TOOL

FIELD OF THE DISCLOSURE

The disclosures made herein relate generally to arts and crafts and, more particularly, to tools for forming crafts from sheets of conformable material.

BACKGROUND

Literally millions of people engage in the activity of making crafts. Some people make crafts purely for reasons of enjoyment and relaxation. Others make crafts with the end objective of selling their crafts for financial gain. Regardless of the reason for making crafts, craftmakers are generally open to new types of crafts and tools for making crafts. Like any hobby or business endeavor, there is often a drive by those engaged in such activities for new challenges and opportunities.

A craft-making tool that enables a broad range of unique and useful crafts to be made will generally be more desirable and/or useful to a craftsperson than is a craft-making tool that offers limited versatility. Similarly, a craft-making tool that enables such broad range of unique and useful crafts to be made in a simple, inexpensive manner will generally be more desirable and/or useful to a craftsperson than is a craft-making tool that is cumbersome to use and that requires the use of costly materials. Therefore, a craft-making tool that enables a broad range of crafts to be made in a simple and inexpensive manner offers useful and advantageous results.

SUMMARY OF THE DISCLOSURE

Embodiments of the present invention enable a broad range of unique and useful crafts to be made. More specifically, embodiments of the present invention enable such broad range of unique and useful crafts to be made in a simple and inexpensive manner. In doing so, embodiments of the present invention provide for useful and advantageous results with respect to many types of conventional craft-making tools.

In one embodiment of the present invention, a method for forming crafts from sheets of conformable material comprises manually wrapping a sheet of conformable material around an exterior side face of an annular extension of an annular extension carrying tool component such that a portion of the sheet of conformable material extends past an end face of the annular extension, manually tucking the portion of the sheet of conformable material extending past the end face of the annular extension against the end face of the annular extension and forcibly engaging the annular extension within an encompassing groove of a groove carrying tool component such that an engaged portion of the sheet of conformable material positioned between annular extension carrying tool component and the groove carrying tool component is conformed within the groove.

In another embodiment of the present invention, a tool for forming articles from sheets of conformable material comprises a groove carrying tool component and an annular extension carrying tool component. The groove carrying tool component includes an encompassing groove formed in a face thereof whereby the encompassing groove defines a protrusion encompassed thereby. The annular extension carrying tool component includes an annular extension engagable within the encompassing groove for enabling an engaged portion of a sheet of conformable material positioned between the groove carrying tool component and the annular extension carrying tool component to be conformed within the groove by forcibly engaging the annular extension within the encompassing groove.

In another embodiment of the present invention, a tool for forming articles from sheets of conformable material comprises a base and a handle. The base includes a circular-shaped groove formed in a face thereof whereby the circular-shaped groove defines a circular-shaped protrusion encompassed thereby. The handle includes a circular-shaped annular extension engagable within the circular-shaped groove for enabling an engaged portion of a sheet of conformable material positioned between the base and the handle to be conformed within the circular-shaped groove by forcibly engaging the circular-shaped annular extension within the circular-shaped groove.

Turning now to specific aspects of the present invention, in at least one embodiment, manually wrapping the sheet of conformable material around the exterior side face of the annular extension includes aligning an edge of the sheet of conformable material with at least one alignment mark provided on the annular extension carrying tool component.

In at least one embodiment of the present invention, the protrusion, the encompassing groove and the annular extension are sized such that, when the annular extension is engaged within the encompassing groove, a first gap is provided between an inner side face of the annular extension and an inner side face of the encompassing groove and a second gap is provided between an outer side face of the annular extension and an outer side face of the encompassing groove.

In at least one embodiment of the present invention, the annular extension defines a closed-ended recess and a depth of the closed-ended recess is approximately the same as a depth of the encompassing groove.

In at least one embodiment of the present invention, the groove carrying tool component includes an alignment passage at a top face of the protrusion, the annular extension carrying tool component includes an alignment passage at a terminal face of the closed-ended recess and the alignment passage of the annular extension carrying tool component is alignable with the alignment passage of the groove carrying tool component when the annular extension is engaged within the encompassing groove.

In at least one embodiment of the present invention, the annular extension carrying tool component includes a plurality of alignment marks on an exterior side face thereof.

In at least one embodiment of the present invention, a first alignment mark extending generally parallel with a longitudinal reference axis of the annular extension carrying tool component is provided, a second alignment mark skewed with respect to the longitudinal reference axis of the annular extension carrying tool component is provided and a third alignment mark extending substantially perpendicular with the longitudinal reference axis of the annular extension carrying tool component is provided.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
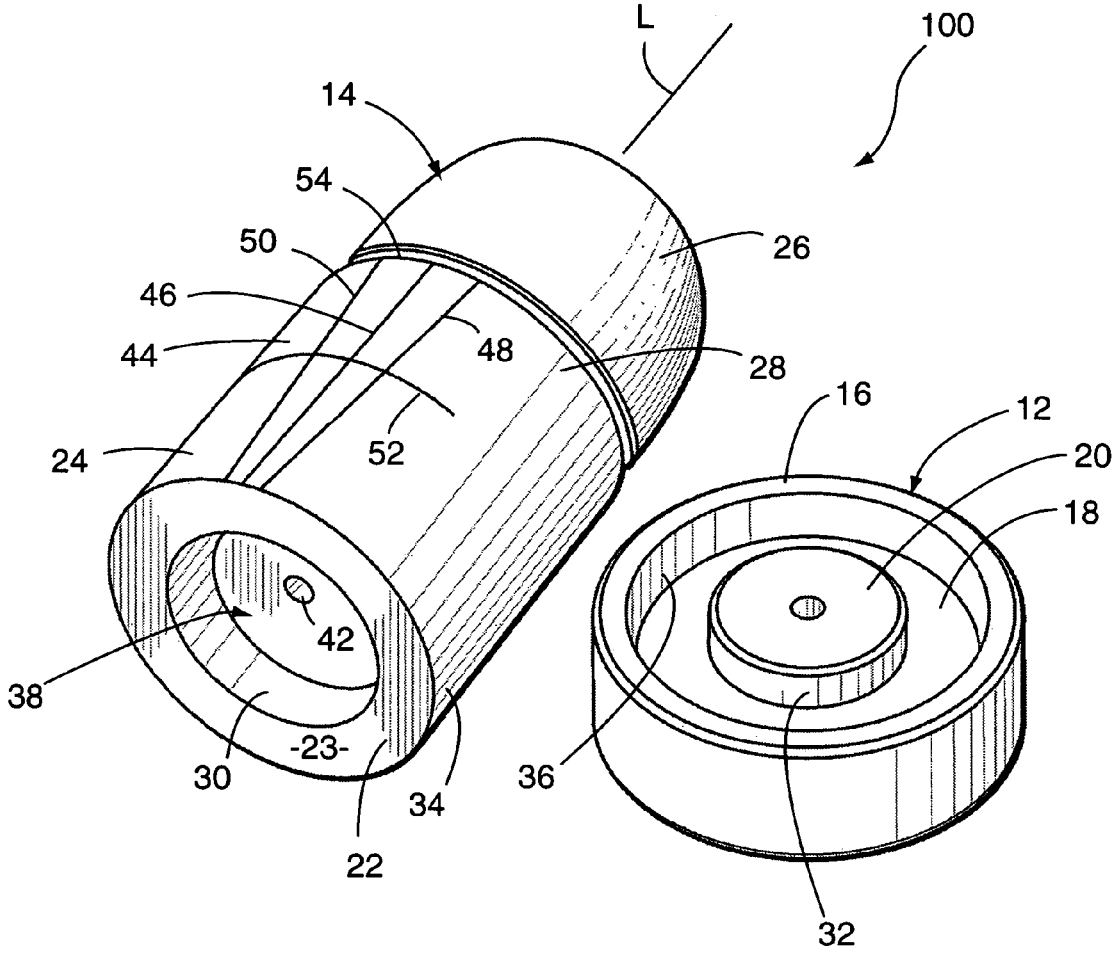
FIG. 1 is a perspective view depicting components of a tool in accordance with the present invention.
Figure 2:
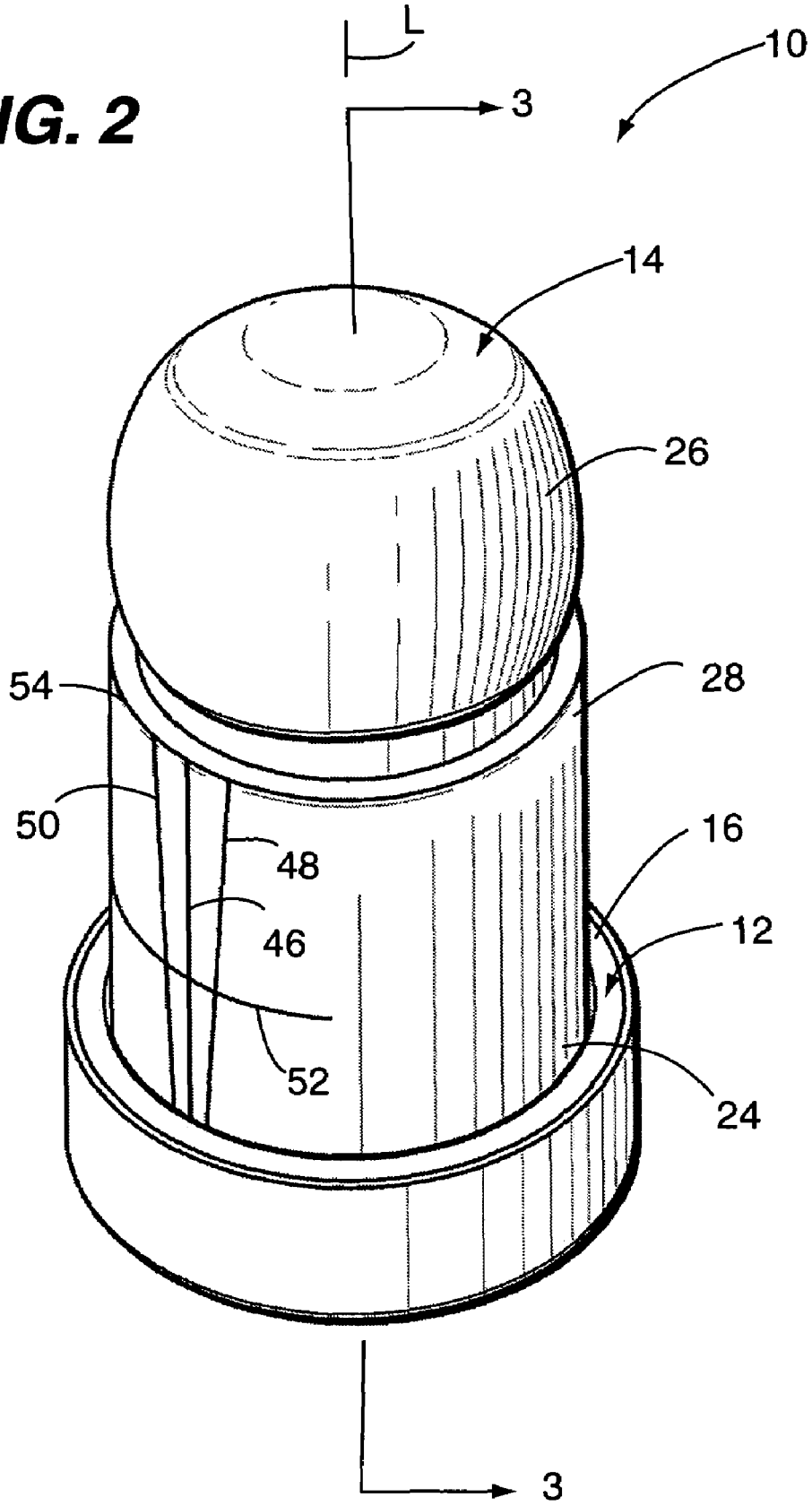
FIG. 2 is a perspective view showing the tool components of FIG. 1 engaged with each other.
Figure 3:
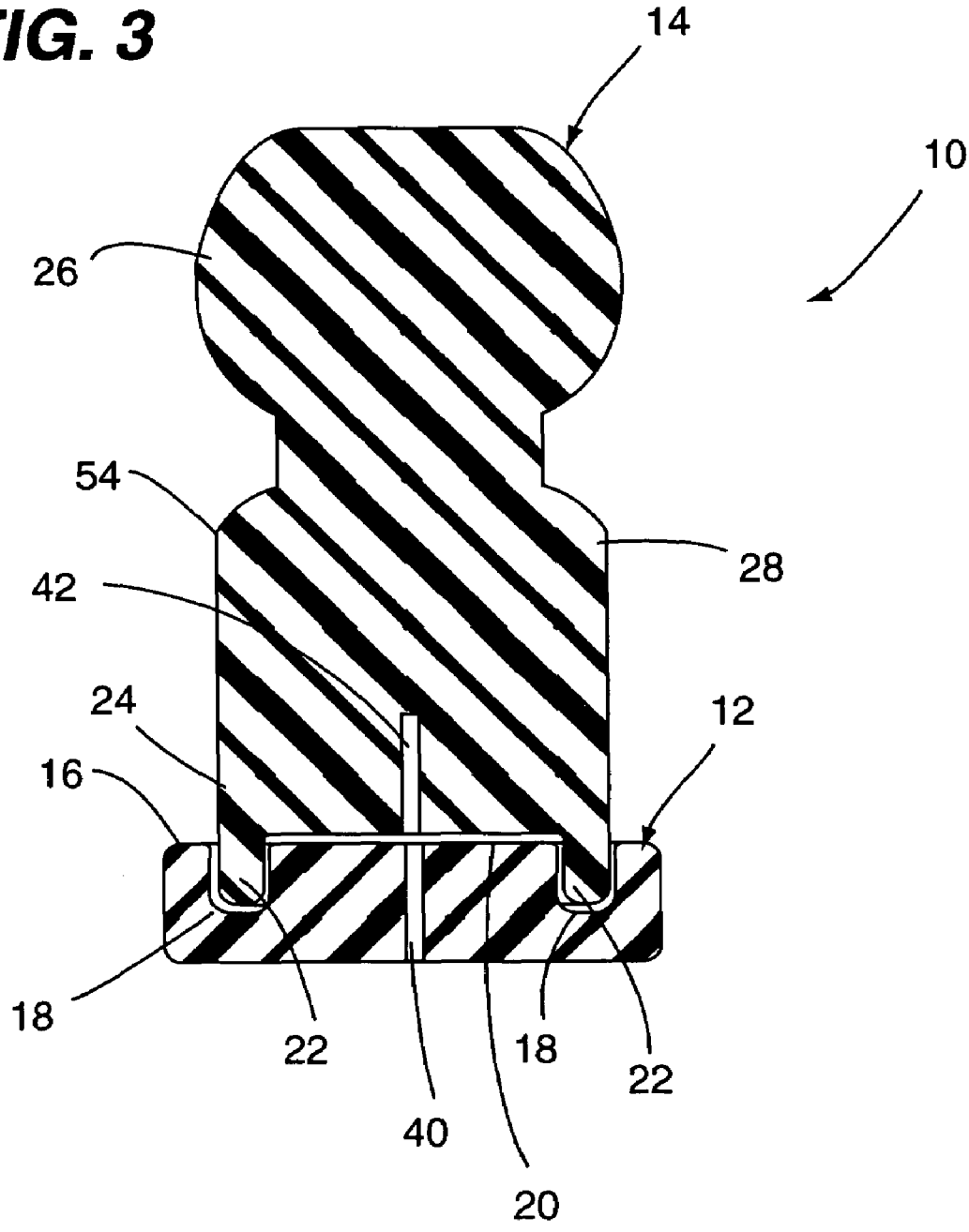
FIG. 3 is a cross-sectional view taken along the line 3-3 in FIG. 2.

FIGS. 1-3 depict an embodiment of a tool for forming articles from sheets of conformable material in accordance with the present invention. The tool for forming articles from sheets of conformable material is referred to herein as the tool 10. The tool 10 includes a base 12 and a handle 14, which are jointly configured for providing the functionality of forming articles from sheets of conformable material.

The base 12 includes a generally flat face 16 and a circular-shaped groove 18 formed in the generally flat face 16. The circular-shaped groove 18 defines a circular-shaped protrusion 20. The circular shape groove 18 entirely encompasses the circular-shape protrusion 20. In this manner, the base 12 is an example of a groove carrying tool component in accordance with the present invention and the circular shaped groove 18 is an example of an encompassing groove in accordance with the present invention.

Preferably, the base 12 has a generally circular exterior profile. However, it is disclosed herein that the exterior profile of the base 12 is not limited to a particular shape or contour. For example, for enhancing hand gripping of the base 12, the exterior profile of the base 12 may have a non-uniform profile with one or more finger engaging recesses.

The handle 14 includes a circular-shaped annular extension 22 engagable within the circular-shaped groove 18. The circular-shaped annular extension 22 is provided at a first end 24 of the handle 14. The circular-shaped annular extension 22 has a generally flat end face 23. A hand-gripping member 26 is provided at a second end 28 of the handle 14. Through engagement with the circular-shaped groove 18, the circular-shaped annular extension 22 enables an engaged portion of a sheet of conformable material positioned between the base 12 and the handle 14 to be conformed within the circular-shaped groove 18 by forcibly engaging the circular-shaped annular extension 22 within the circular-shaped groove 18. To limit damage to the sheet of conformable material as a result of relatively high contract pressure, it is preferred that the edges of the circular-shaped groove 18 and the circular-shaped annular extension 22 are broken (e.g., rounded, bevelled, etc).

Preferably, the hand-gripping member 26 of the handle 14 has a generally circular exterior profile. However, it is disclosed herein that the exterior profile of the hand-gripping member 26 is not limited to a particular shape or contour. For example, for enhancing hand gripping of the hand-gripping member 26 and, optionally other portions of the handle 14, the exterior profile of the hand gripping member 26 and/or other portions of the handle 14 may have a non-uniform profile with one or more finger engaging recesses.

The circular-shaped groove 18 and the circular-shaped annular extension 22 are sized such that, when the circular-shaped annular extension 22 is engaged within the circular-shaped encompassing groove 18, a first gap is provided between an inner side face 30 of the circular-shaped annular extension 22 and an inner side face 32 of the circular-shaped groove 18 and a second gap is provided between an outer side face 34 of the circular-shaped annular extension 22 and an outer side face 36 of the circular-shaped groove 18. The first gap and the second gap are provided for receiving the engage portion of the sheet of conformable material when the annular extension 22 is engaged with the groove 18. The specific dimension of the first gap and the second gap are specified dependent upon a prescribed and/or anticipated thickness range for the sheets of conformable material useful with the tool 10.

The circular-shaped annular extension 22 defines a closed-ended recess 38. Preferably, but not necessarily, a depth of the closed-ended recess 38 is approximately the same as a depth of the circular-shaped groove 18. It is disclosed herein that the depth of the closed-ended recess 38 may be substantially greater than the depth of the circular-shaped groove 18 and that one or more spacers 39 (FIG. 4) may be provided that are sized for being received within the closed ended recess 38. The thickness of the one or more spacers enables an effective depth of the closed ended 38 to be adjustable. Similarly, the circular-shaped protrusion 20 may be comprised entirely of removable spacers or configured for having one of more spaces mounted thereon such that an effective height of the circular-shaped protrusion 20 is adjustable.

The base 12 includes an alignment passage 40. Preferably, the alignment passage 40 of the base 12 is centrally located with respect to the groove 18 and is exposed at a top face of the circular-shaped protrusion 20. The handle 14 includes an alignment passage 42. Preferably, the alignment passage 42 of the circular-shaped annular extension 22 is centrally located with respect to the circular-shaped annular extension 22 and is exposed at a terminal face of the closed-ended recess 38. The alignment passage 42 of the handle 14 is alignable with the alignment passage 40 of the base 12 when the circular-shaped extension 22 is engaged within the circular-shaped groove 18. The alignment passages (40, 42) are provided for the purpose of enabling an alignment device (e.g., a dowel) to be used for achieving relatively precise alignment of the base 12 to the handle 14 and/or for securing the one or more spacers (discussed above) in place during conforming of a sheet of conformable material.

Figure 4:
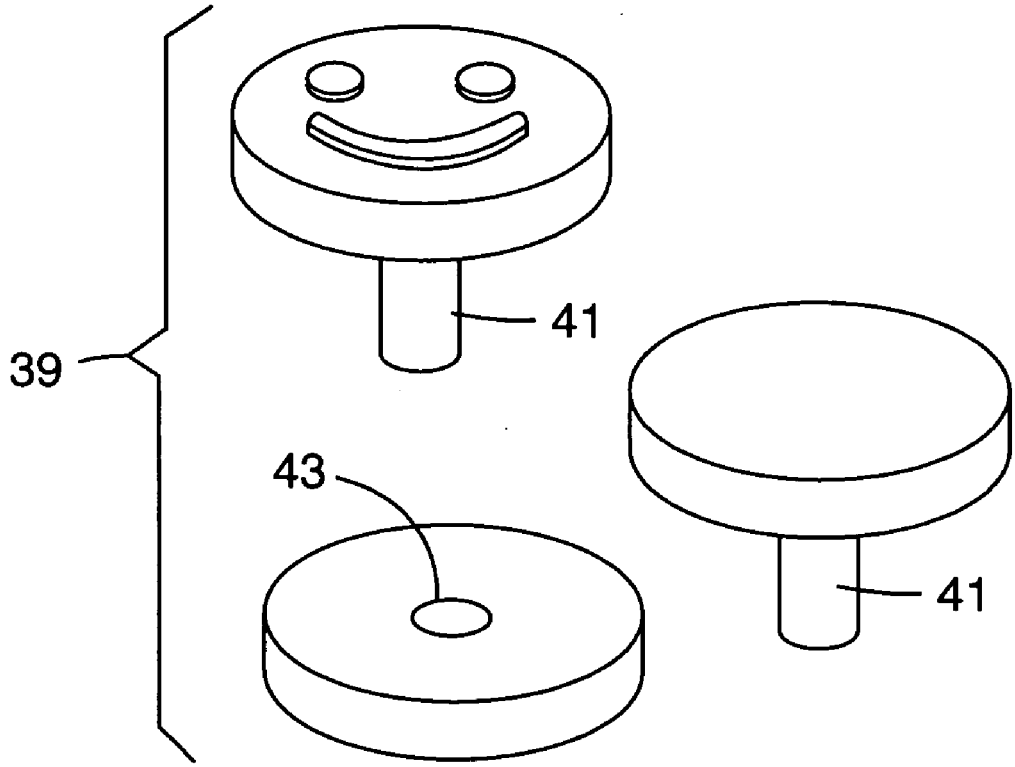
FIG. 4 is a perspective view of a set of spacers in accordance with the present invention.

As depicted in FIG. 4, one or more of the spacers 39 includes an alignment pin 41 and one or more of the spacers 39 includes an alignment hole 43. The pin 41 is enables the corresponding spacer 39 to be positioned by engaging the pin 41 with the alignment passage 40 of the base 12 or with the alignment passage 42 of the handle 14. The alignment hole 43 enables the corresponding one of the spacers 39 to be positioned on the pin 41 of another one of the spacers 39. Preferably, the pin 41 is longer than the thickness of the spacer 39 with the alignment hole 43, such that even with a spacer 39 engaged on a pin 41, the pin 41 is engagable with the alignment passage 40 of the base 12 or alignment passage 42 of the handle 14. In this manner, the spacers 39 are interchangeable and positively positionable.

As also depicted in FIG. 4, one or more of the spacers 39 may have indicia on a sheet-contacting surface thereof for forming a corresponding impression in an engaged sheet of conformable material. Examples of such indicia include, but are not limited to, letters, numbers, logos, shapes and the like. It is disclosed herein that the indicia may include raised portions, recessed portions or both.

It is disclosed herein that the spacers 39 may each be configured with a pin extending from a first major surface thereof and an alignment hole assessable at a second major surface thereof. In such a configuration each one of the spacers 39 would be stackable on each other one of the spacers 39. Such a stackable configuration increases versatility with regard to stacking of the spacers 39.

A plurality of alignment marks is provided on an exterior side face 44 of the handle 14. A first alignment mark 46 extends generally parallel with a longitudinal reference axis L of the handle 14. A second alignment mark 48 is skewed clockwise with respect to the longitudinal reference axis L of the handle 14 and a third alignment mark 50 is skewed counter-clockwise with respect to the longitudinal reference axis L of the handle 14. A fourth alignment mark 52 extends substantially perpendicular with the longitudinal reference axis L of the handle 14. A ridge edge 54 of the handle serves as a fifth alignment mark extending generally parallel with and offset from the fourth alignment mark 52. As will be discussed below, the alignment indicia (46-54) are used for aligning a sheet of conformable material on the handle 14 during wrapping of the sheet of conformable material around the handle 14 to achieve a corresponding size and top edge configuration in a formed article.

FIGS. 5-8 depict an embodiment of a method of making an article from a sheet of conformable material using a tool in accordance with the present invention. In the depicted embodiment, the tool is the tool 10 depicted in FIGS. 1-3. Accordingly, the reference nomenclature of FIGS. 1-3 is generally used when referring to specific aspects of the tool 10 in discussing the method of FIGS. 5-8.

Figure 5:
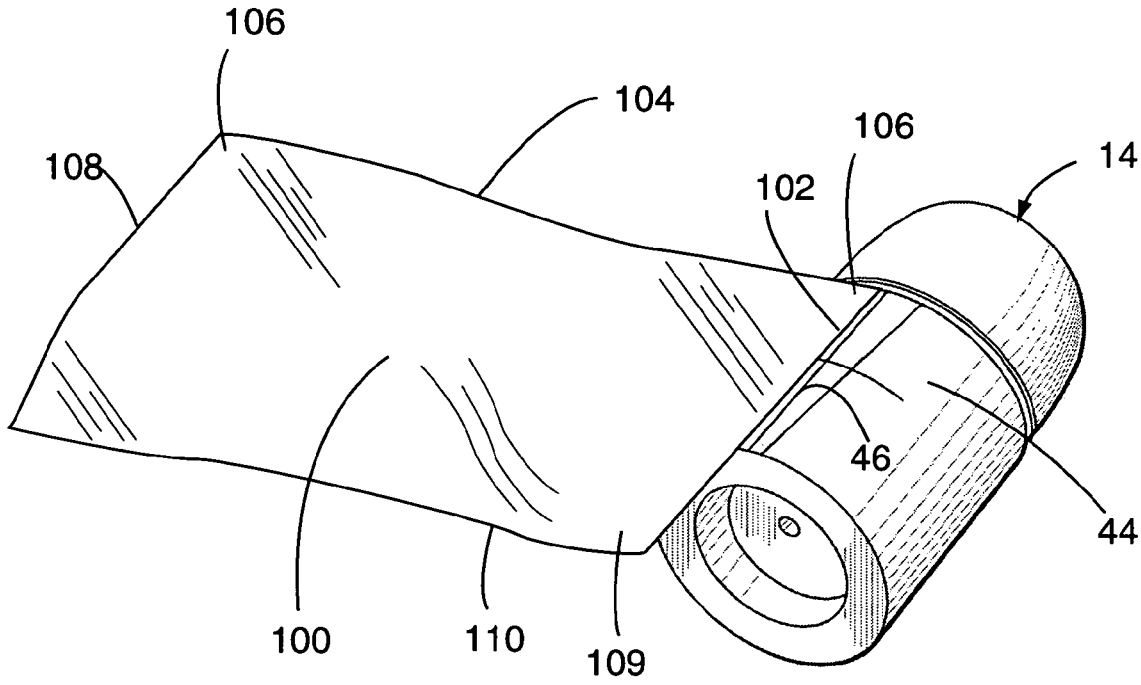
FIG. 5 depicts a sheet of conformable material being aligned with alignment indicia of a handle component of the tool depicted in FIGS. 1-3.

Referring to FIG. 5, the method includes manually wrapping a sheet of conformable material (i.e., the sheet 100) around the exterior side face 44 of the annular extension 22 of the handle 12. Examples of the conformable sheet 100 include, but are not limited to, a sheet of paper (e.g., newspaper, phonebook pages, craft paper, etc), a sheet of foil, a sheet of plastic, a sheet of cardboard, etc. A starting edge 102 of the sheet 100 is aligned with the first alignment mark 46 of the handle 14 and a top edge 104 of the sheet 100 is aligned with the ridge edge 54. This alignment is used for producing a full height article having a top edge of each wrap substantially aligned with the next, as is discussed in greater detail below with respect to FIG. 9. Alignment of the top edge 104 of the sheet 100 with the fourth alignment mark 52 produces a reduced height article (e.g., half height) in contrast to alignment the ridge edge 54. The sheet 100 is sized such that a portion 109 of the sheet 100 adjacent a bottom edge 110 of the sheet 100 extends past the end face 23 of the annular extension 22.

Figure 6:
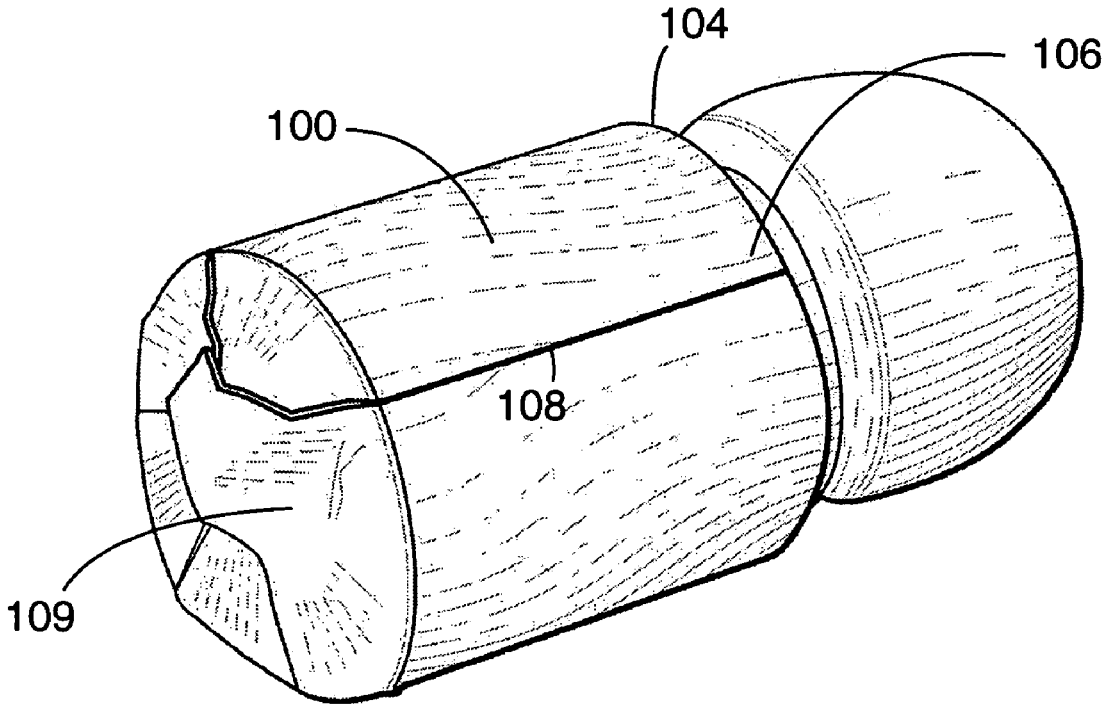
FIG. 6 depicts the sheet of conformable material in FIG. 5 being fully wrapped onto the handle of the tool and tucked against an end face of the annular extension of the handle.

Referring to FIG. 6, after wrapping the entire sheet 100 around the exterior side face 44 of the handle 14, the portion 109 of the sheet 100 that extends past the end face 23 of the annular extension 22 is manually tucked against the end face 23 of the annular extension 22. To enhance uniformity and structural integrity of the finished article, it is preferable and beneficial for the sheet 100 to be wrapped relatively tightly and for the portion 109 of the sheet 100 that extends past the end face 23 of the annular extension 22 to be tucked against the end face 23 relatively orderly and tightly.

Figure 7:
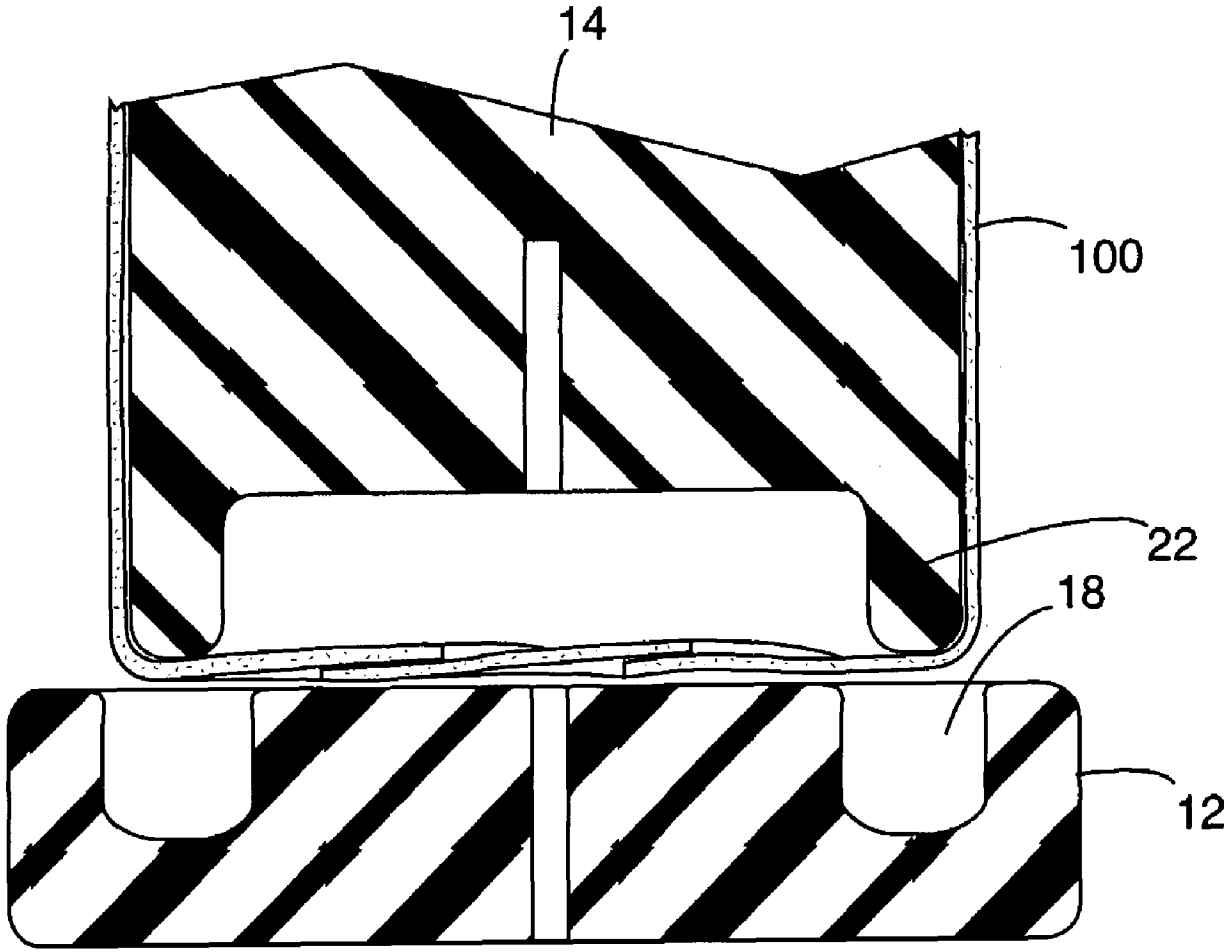
FIG. 7 depicts the sheet-wrapped handle of FIG. 6 in engagement position with respect to a base component of the tool.
Figure 8:
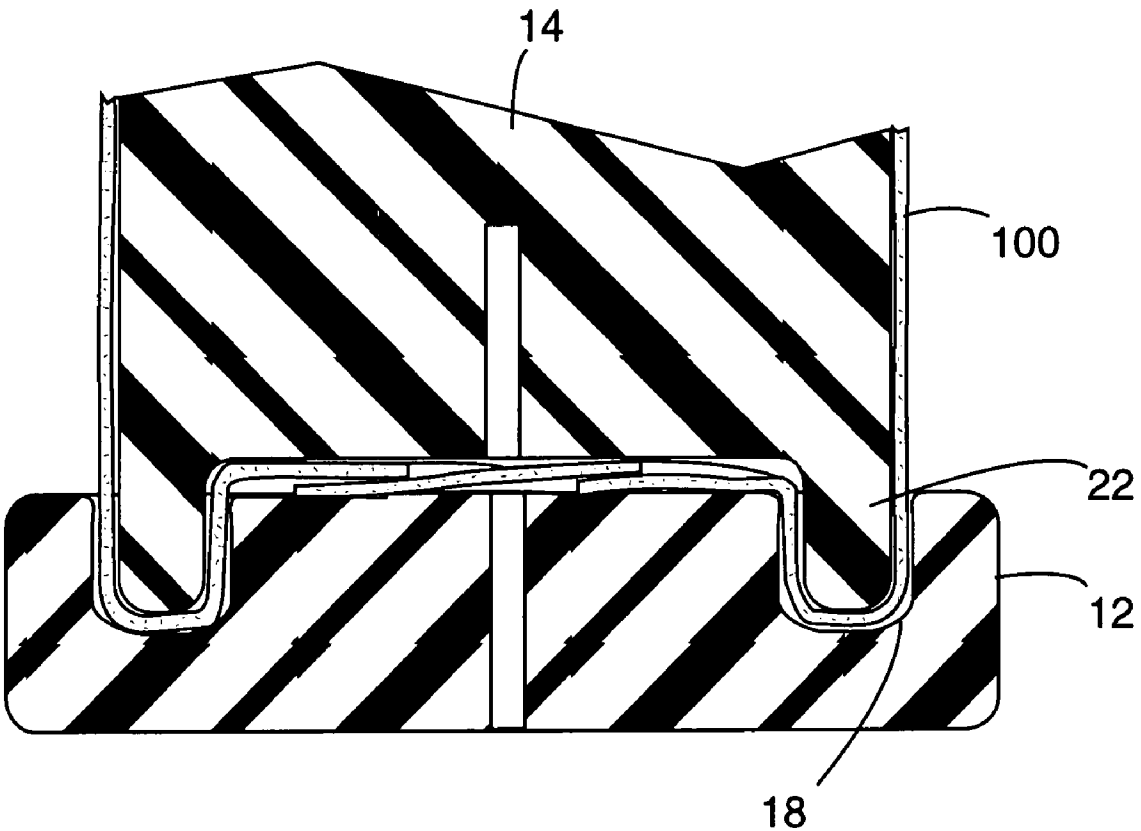
FIG. 8 depicts the sheet-wrapped handle being forcibly engaged with the base.

Referring to FIG. 7, the handle 14, which is wrapped with the sheet 100, is positioned with the annular extension 22 positioned in general alignment with the groove 18. As is shown in FIG. 8, the annular extension 22 is then forcibly engaged within the groove 18. Such forcible engagement included application of a longitudinal force and, optionally, a relative twisting action of the handle 14 with respect to the base 12. In this manner, the portion of the sheet 100 positioned between base 12 and the handle 14 is conformed within the groove 18 and takes on the generally shape of the interface (i.e., the gap) between the base 12 and the handle 14, thereby producing an article 112 that can be used in any number of craft projects.

Examples of craft projects created using articles formed in accordance with the present invention include, but are not limited to cups, short bowls and containers with covers (i.e., comprising two formed articles having interlocking open ends). It is disclosed herein that a sheet of conformable material need not be wrapped around the handle of a tool. In fact, such non-wrapped configuration produces a plate-like article having a recessed center-section and raised edge section.

Figure 9:
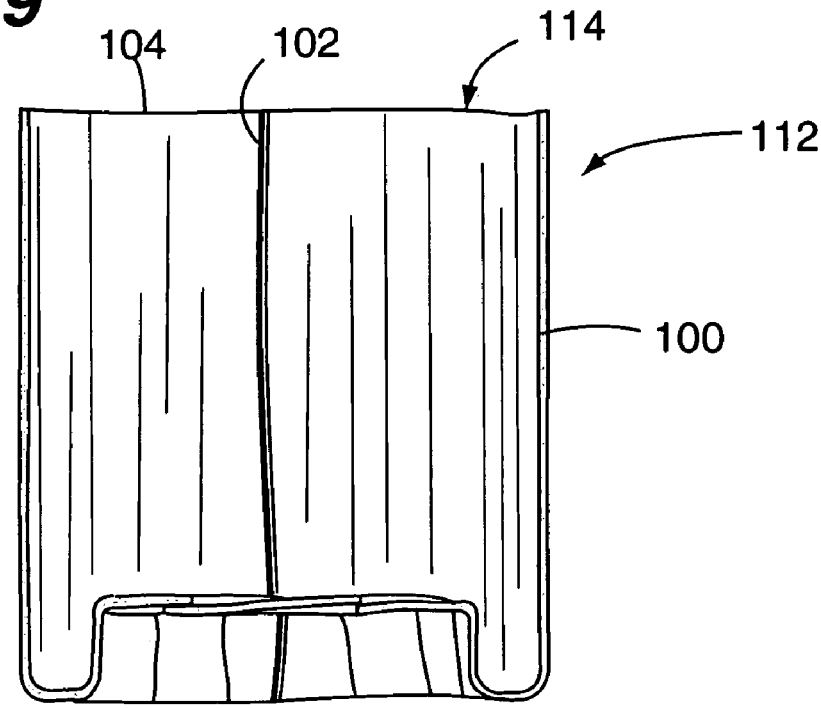
FIG. 9 depicts a resulting article formed using the article forming techniques depicted in FIGS. 5-8.

Referring to FIGS. 5 and 9, aligning the starting edge 102 of the sheet 100 with the first alignment mark 46 results in an article 112 having a top edge 114 with each of wrap of the material 100 being substantially aligned with the next.

Figure 10:
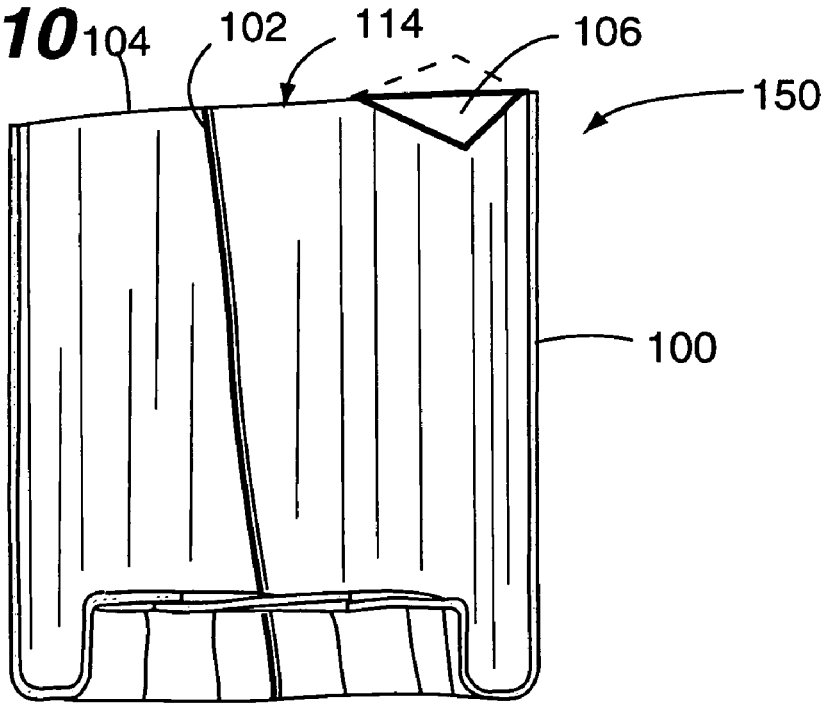
FIG. 10 depicts a resulting article formed using an alternate article forming technique in accordance with the present invention and using the tool depicted in FIGS. 1-3.

It is disclosed herein that alignment of the starting edge 102 of the sheet 100 with either the second alignment mark 48 of the third alignment mark 50 produces a top edge wrapped in a helical manner. The helical wrapping results in either a top corner 106 at the starting edge 102 (FIG. 5) or a top corner 106 at a terminal edge 108 of the sheet 100 (FIG. 5) being exposed after the sheet 100 is wrapped onto the handle 14. As shown in the article 150 of FIG. 10, the exposed corner 106 in a resulting article with such helical wrapping may be dog-eared' to hold the wrapped layers of the sheet 100 in place.

A skilled person will appreciate that the tool of the present invention is not limited to being made from a particular type of material. It is disclosed herein that a tool in accordance with the present invention may be made from materials such as, for example, wood, plastic, metal and composite material. Examples of manufacturing techniques used for making a tool in accordance with the present invention include, but are not limited to, turning, molding, casting, milling and other known techniques.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A tool for forming articles from sheets of conformable material, comprising:

a groove carrying tool component including an encompassing groove formed in a face thereof whereby the encompassing groove defines a protrusion encompassed thereby; and an annular extension carrying tool component including an annular extension engagable within the encompassing groove for enabling an engaged portion of a sheet of conformable material positioned between the groove carrying tool component and the annular extension carrying tool component to be conformed within the groove by forcibly engaging the annular extension within the encompassing groove;

wherein the groove carrying tool component includes an alignment passage at a top face of the protrusion;

wherein the annular extension carrying tool component includes an alignment passage at a terminal face of the closed-ended recess; and wherein the alignment passage of the annular extension carrying tool component is alignable with the alignment passage of the groove carrying tool component when the annular extension is engaged within the encompassing groove;

wherein an alignment mark generally parallel to a longitudinal reference axis of the annular extension carrying tool component is provided on an exterior side face of the annular extension carrying tool component;

wherein an alignment mark skewed with respect to the longitudinal reference axis of the annular extension carrying tool component is provided on the annular extension carrying tool component; and wherein an alignment mark extending substantially perpendicular with the longitudinal reference axis of the annular extension carrying tool component is provided on the annular extension carrying tool component.

2. A tool for forming articles from sheets of conformable material, comprising:

a groove carrying tool component including an encompassing groove formed in a face thereof whereby the encompassing groove defines a protrusion encompassed thereby; and an annular extension carrying tool component including an annular extension engagable within the encompassing groove for enabling an engaged portion of a sheet of conformable material positioned between the groove carrying tool component and the annular extension carrying tool component to be conformed within the groove by forcibly engaging the annular extension within the encompassing groove;

wherein the annular extension carrying tool component includes a plurality of alignment marks on an exterior side face thereof;

wherein the plurality of alignment marks include:

a first alignment mark extending generally parallel with a longitudinal reference axis of the annular extension carrying tool component;

a second alignment mark skewed with respect to the longitudinal reference axis of the annular extension carrying tool component; and a third alignment mark extending substantially perpendicular with the longitudinal reference axis of the annular extension carrying tool component.

3. The tool of claim 2 wherein:

the groove carrying tool component includes an alignment passage at a top face of the protrusion;

the annular extension carrying tool component includes an alignment passage at a terminal face of the closed-ended recess; and the alignment passage of the annular extension carrying tool component is alignable with the alignment passage of the annular extension carrying tool component when the annular extension is engaged within the encompassing groove.

4. The tool of claim 3 wherein the protrusion, the encompassing groove and the annular extension are sized such that, when the annular extension is engaged within the encompassing groove;

a first gap is provided between an inner side face of the annular extension and an inner side face of the encompassing groove; and a second gap is provided between an outer side face of the annular extension and an outer side face of the encompassing groove.

5. A tool for forming articles from sheets of conformable material, comprising:

a base including a circular-shaped groove formed in a face thereof whereby the circular-shaped groove defines a circular-shaped protrusion encompassed thereby; and a handle including a circular-shaped annular extension engagable within the circular-shaped groove for enabling an engaged portion of a sheet of conformable material positioned between the base and the handle to be conformed within the circular-shaped groove by forcibly engaging the circular-shaped annular extension within the circular-shaped groove;

wherein the base includes an alignment passage at a top face of the protrusion;

wherein the handle includes an alignment passage at a terminal face of the closed-ended recess;

wherein the alignment passage of the handle is alignable with the alignment passage of the base when the circular-shaped extension is engaged within the circular-shaped groove;

wherein an alignment mark generally parallel to a longitudinal reference axis of the handle is provided on an exterior side face of the handle;

wherein an alignment mark skewed with respect to the longitudinal reference axis of the handle is provided on the exterior side face of the handle; and wherein an alignment mark extending substantially perpendicular with the longitudinal reference axis of the handle is provided on the exterior side face of the handle.

6. A tool for forming articles from sheets of conformable material, comprising:

a base including a circular-shaped groove formed in a face thereof whereby the circular-shaped groove defines a circular-shaped protrusion encompassed thereby; and a handle including a circular-shaped annular extension engagable within the circular-shaped groove for enabling an engaged portion of a sheet of conformable material positioned between the base and the handle to be conformed within the circular-shaped groove by forcibly engaging the circular-shaped annular extension within the circular-shaped groove;

wherein the handle includes a plurality of alignment marks on an exterior side face thereof; and wherein the plurality of alignment marks include:

a first alignment mark extending generally parallel with a longitudinal reference axis of the handle;

a second alignment mark skewed with respect to the longitudinal reference axis of the handle; and a third alignment mark extending substantially perpendicular with the longitudinal reference axis of the handle.

7. The tool of claim 6 wherein:

the base includes an alignment passage at a top face of the protrusion;

the handle includes an alignment passage at a terminal face of the closed-ended recess; and the alignment passage of the handle is alignable with the alignment passage of the handle when the circular-shaped annular extension is engaged within the circular-shaped groove.

8. The tool of claim 7 wherein the protrusion, the circular-shaped groove and the circular-shaped annular extension are sized such that, when the circular-shaped annular extension is engaged within the circular-shaped encompassing groove;

a first gap is provided between an inner side face of the circular-shaped annular extension and an inner side face of the circular-shaped groove; and a second gap is provided between an outer side face of the circular-shaped annular extension and an outer side face of the circular-shaped groove.

* * * * *